United States Patent [19]

Sim

[11] Patent Number: 5,054,131

[45] Date of Patent: Oct. 8, 1991

[54] TOILET ASSEMBLY

[76] Inventor: Jae K. Sim, 619 S. Orange Dr., Los Angeles, Calif. 90036

[21] Appl. No.: 545,694

[22] Filed: Jun. 29, 1990

[51] Int. Cl.[5] ..... E03D 9/04

[52] U.S. Cl. ..... 4/216

[58] Field of Search ..... 4/347–352, 4/213, 216, 217

[56] References Cited

U.S. PATENT DOCUMENTS

| | | | |
|---|---|---|---|
| 2,228,920 | 1/1941 | Baither | 4/213 |
| 2,297,935 | 10/1942 | Baither | 4/213 |
| 2,329,221 | 9/1943 | Sanford | 4/213 |
| 2,443,705 | 6/1948 | Fitzgerald | 4/213 |
| 2,575,778 | 11/1951 | Wilson | 4/213 |
| 2,817,099 | 12/1957 | Fitzgerald | 4/215 |
| 2,847,682 | 8/1958 | Shay | 4/213 |
| 3,102,275 | 9/1963 | Raymond | 4/213 |
| 3,192,539 | 7/1965 | Martz | 4/213 X |
| 3,495,282 | 2/1970 | Taggart | 4/213 |
| 3,805,304 | 4/1974 | Ikehata | 4/72 |
| 4,141,091 | 2/1979 | Palvari | 4/313 |
| 4,222,129 | 9/1980 | Baker | 4/213 |
| 4,232,406 | 11/1980 | Beeghly et al. | 4/213 |
| 4,318,192 | 3/1982 | Williams et al. | 4/213 |
| 4,365,361 | 12/1982 | Sanstrom | 4/213 |
| 4,494,255 | 1/1985 | Drummond | 4/213 |
| 4,864,664 | 9/1989 | Higgins | 4/213 |

*Primary Examiner*—Charles E. Phillips

*Attorney, Agent, or Firm*—Birch, Stewart, Kolasch & Birch

[57] ABSTRACT

A toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion sensor disposed on the front exterior of the toilet holding tank and free of interference from the opening and closing of a toilet seat cover, and an U-shaped gas exhaust duct disposed in the toilet holding tank and connected to the ventilation conduit for allowing exhaust gas to flow from a flush ring to the ventilation conduit, whereby upon opening the toilet seat cover, while the user sits on the seat ring, the motion sensor is actuated to operate the fan member and the objectionable odor is ventilated, and in turn when the user stands and flushes the toilet assembly, the motion sensor is deactivated and simultaneously the flush water discharges the waste product and associated objectionable odor directly to the sewer discharge line.

5 Claims, 2 Drawing Sheets

TOILET ASSEMBLY

BACKGROUND OF THE INVENTION

1. Field of the Invention

The present invention relates to a toilet assembly and more particularly, to a ventilating toilet assembly which includes a toilet stool having a ventilation conduit disposed adjacent to the back wall portion of the toilet stool for ventilating objectionable odor from the toilet bowl, the ventilation conduit extending annularly around the siphon conduit at the point where they communicate with a sewer discharge line, a fan disposed in the lower portion of the ventilation conduit, a toilet holding tank having a motion sensor disposed on the front exterior of the toilet holding tank and free of interference from the opening and closing of the toilet seat cover, and an U-shaped gas exhaust duct and disposed in the toilet holding tank and connected to and communicating with the ventilation conduit for allowing exhaust gas to flow from a flush ring to the ventilation conduit, whereby upon opening the toilet seat cover, while the user sits on the seat ring, the motion sensor is actuated to operate the fan means and the objectionable odor is ventilated, and in turn when the user stands and flushes the toilet assembly, the motion sensor is deactivated and simultaneously the flush water discharges the waste product and associated objectionable odor directly to the sewer discharge line.

2. Field of the Prior Art

Various types of ventilating toilets are generally known to be utilized with a fan for ventilating a contaminated air through a separate exhaust duct. Several types of ventilating toilets are known to be utilized with a gas exhaust duct disposed adjacent to a toilet stool and connected to a sewer discharge line or a siphon conduit. However, these toilets suffer from a number of problems such as, for example, (1) the waste product and associated objectionable odor does not clearly discharge directly to a sewer discharge line since the ventilating conduit is directly connected to the sewer discharge line or the siphon conduit, (2) it is very complicated in construction, expensive to manufacture, and difficult in use, (3) since the flush water flows backward to the ventilating conduit, an amount and a water pressure of the flush water are minimized so that these toilets cannot be effectively achieved the flush purpose thereof, and (4) since such toilets are utilized with a relay type or an on/off switch for activating a fan means, this switch may be gotten out of order frequently. Furthermore, such toilets do not disclose the use of a water overflowing system and if they have it, it is very complicated and it does not work effectively. Some prior toilets are described in Baither U.S. Pat. No. 2,227,920, Baither U.S. Pat. No. 2,297,935, Sanford U.S. Pat. No. 2,329,221, Fitzgerald U.S. Pat. No. 2,443,705, Wilson U.S. Pat. No. 2,575,778, Fitzgerald U.S. Pat. No. 2,817,099, Shay U.S. Pat. No. 2,847,682, Taggart U.S. Pat. No. 3,495,282, Ikehata U.S. Pat. No. 3,805,304, Baker U.S. Pat. No. 4,222,129, Beeghly et al U.S. Pat. No. 4,232,406, Williams et al U.S. Pat. No. 4,318,192, Sanstrom U.S. Pat. No. 4,365,361, Drummond U.S. Pat. No. 4,494,255, and Higgins U.S. Pat. No. 4,865,664.

SUMMARY OF THE INVENTION

Accordingly, it is an object of the present invention to provide an improved ventilating toilet assembly, whereby objectionable odor from the toilet bowl is effectively vented therefrom and discharged into a sewer discharge line.

Another object of the present invention is to provide a toilet assembly which includes a toilet stool having a ventilation conduit disposed adjacent to the back wall portion of the toilet stool for ventilating objectionable odor from the toilet bowl, the ventilation conduit extending annularly around a siphon conduit at the point where they communicate with the sewer discharge line, a fan disposed in the lower portion of the ventilation conduit, a toilet holding tank having a motion sensor disposed on the front exterior of the toilet holding tank and free of interference from the opening and closing of the toilet seat cover, and an U-shaped gas exhaust duct disposed in the toilet holding tank and connected to and communicating with the ventilation conduit for allowing exhaust gas to flow from a flush ring to the ventilation conduit, whereby upon opening the seat cover, while the user sits on the seat ring, the motion sensor is actuated to operate the fan means and the objectionable odor is ventilated, and in turn when the user stands and flushes the toilet assembly, the motion sensor is deactivated and simultaneously the flush water discharges the waste product and associated objectionable odor directly to the sewer discharge line.

A further object of the present invention is to provide a toilet assembly which further comprises a water overflow controlling ball valve disposed to move in a net chamber disposed at the top area of a gas exhaust tube for, upon overflowing of the flush water, allowing to discharge overflowing water thereinto.

Yet another object of the present invention is to provide a toilet assembly which is simple in construction, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion sensor disposed on the front exterior of the toilet holding tank and free of interference from the opening and closing of a toilet seat cover, and an U-shaped gas exhaust duct disposed in the toilet holding tank and connected to the ventilation conduit for allowing exhaust gas to flow from a flush ring to the ventilation conduit, whereby upon opening the toilet seat cover, while the user sits on the seat ring, the motion sensor is actuated to operate the fan member and the objectionable odor is ventilated, and in turn when the user stands and flushes the toilet assembly, the motion sensor is deactivated and simultaneously the flush water discharges the waste product and associated objectionable odor directly to the sewer discharge line.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
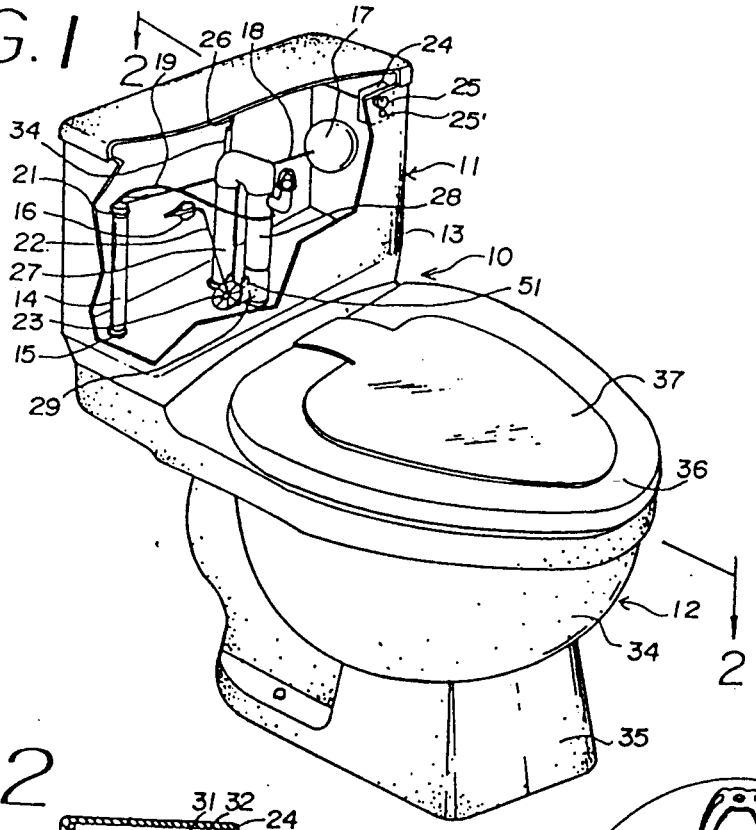
FIG. 1 is a perspective view of the toilet assembly according to the present invention containing cut away portions in order to illustrate the construction thereof.
Figure 2:
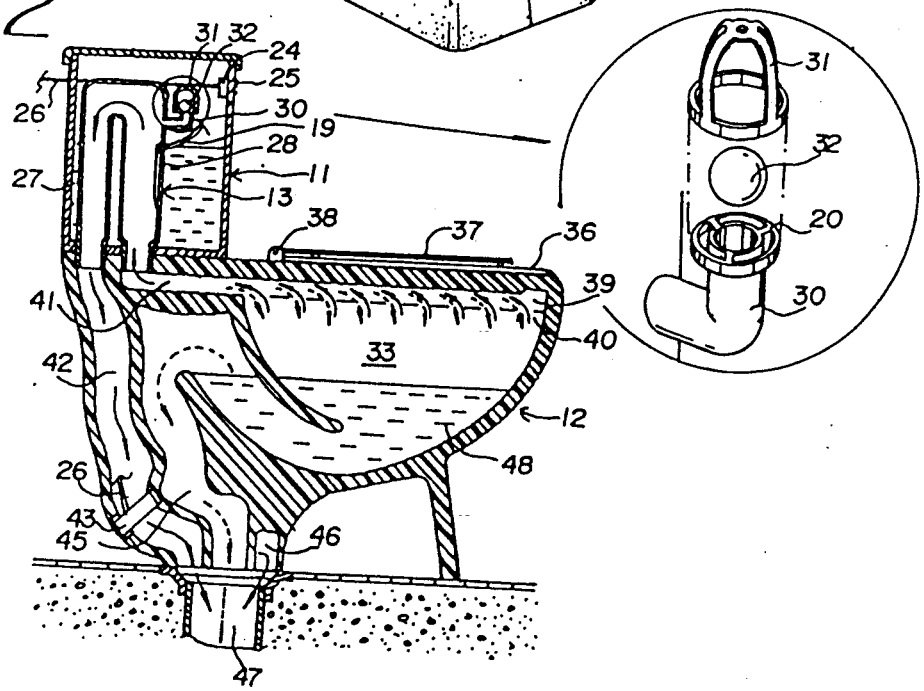
FIG. 2 is a sectional view of FIG. 1, taken along lines 2—2.

Referring now in detail to the drawings for the purpose of illustrating preferred embodiments of the present invention, the toilet assembly 10 as shown in FIGS. 1 and 2, comprises a toilet holding tank 11, a toilet stool 12, a ventilation conduit 42 disposed adjacent to the back wall portion of the toilet stool 12, a motion sensor 24 disposed on the front exterior of the toilet holding tank 11, and an U-shaped gas exhaust duct 13 disposed in the toilet holding tank 11 and provided with a water overflow controlling movable ball valve 32 disposed therein (FIGS. 5 and 6).

As shown in FIG. 2, the toilet stool 12 includes a toilet bowl 33, a flush ring 39 disposed at the upper end of the toilet bowl 33, a plurality of openings 40 communicating with the flush ring 33 for allowing fresh flush water 48 to be flushed into the toilet bowl 33 from the flush ring 39, a seat ring 36 disposed on the flush ring 33, a small toilet seat cover 37 disposed on the peripheral inside edge of the seat ring 36, and a siphon conduit 45 connected to and communicating with the toilet bowl 33 for discharging waste product and associated objectionable odor directly from the toilet bowl 33 to a sewer discharge line 47.

Figure 3:
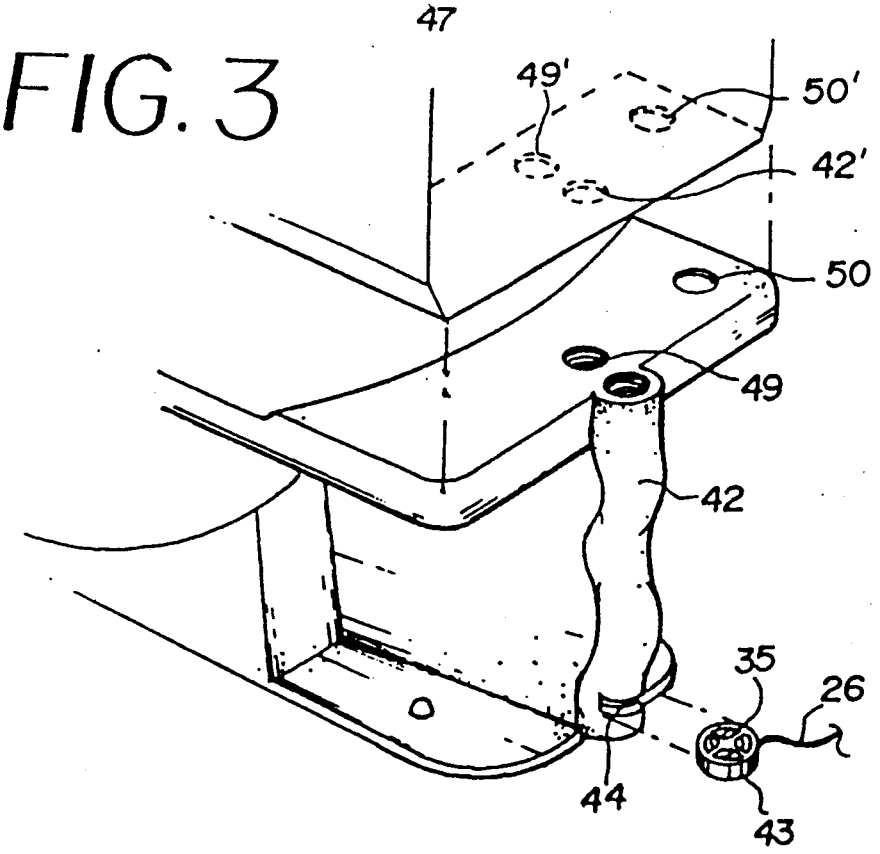
FIG. 3 is an exploded perspective view of a ventilation conduit disposed adjacent to the back wall portion of the toilet stool according to the present invention.

As shown in FIGS. 2 and 3, the ventilation conduit 42 for ventilating objectionable odor from the toilet bowl 33 extends an annular wide end portion 46 disposed annularly around the siphon conduit 45 at the point where they communicate with the sewer discharge line 47. And the ventilation conduit 42 contains a fan 43 disposed in the lower portion thereof. Thus, since the annular wide end portion 46 disposed at the bottom end of the ventilation conduit 42 is disposed annularly around the end portion of the siphon conduit 45 and is connected directly to the sewer discharge line 47, the waste product and associated the objectionable odor can be completely discharged when compared with the conventional vent toilet assemblies. The fan 43 is inserted into a groove 44 disposed in the lower portion of the ventilation conduit 42 and includes a water-proof fan motor 35 connected to an electric source (not shown) through an electric wire 26 which is passed along the ventilation conduit 42, the gas exhaust duct 13, and a wire containing line 34 connected to the motion sensor 24 and the electric source. Also, the electric wire 26 is covered by a water-proof material As shown in FIG. 1, the toilet holding tank 11 contains the flush water 48 to be flushed into the toilet bowl 33 from the flush ring 39 of the toilet stool 12. The toilet holding tank 11 includes a water supply tube 14 connected to a water supply line (not shown) through a water intake valve 15 disposed at the bottom end thereof, a float valve 21 disposed at the top end thereof, a float member 17 connected to the float valve 21 through a rod 18, and a flush handle 16 disposed on the front exterior of the toilet holding tank 11 for connection to a flapper valve 23 through a chain 22. The water supply tube 14 stands at apertures 50 and 50, disposed at the toilet holding tank 11 and the toilet stool 12, respectively (FIG. 3).

The motion sensor 24 is disposed on the front exterior of the toilet holding tank 11 in the opposite side to the flush handle 16 and includes a detector 25 and a sensor acting light 25' (FIG. 1). Also, the motion sensor 24 is not an on/off type switch or a relay type switch so that the motion sensor 24 is durable when compared with the switch of the conventional vent toilet assemblies. Furthermore, since the toilet seat cover 37 disposed on the peripheral inside edge of the seat ring 36 has a small size when compared with the conventional toilet seat cover, the motion sensor 24 is free of interference from the opening and closing of the toilet seat cover 37 (FIG. 1). The motion sensor 24 is connected to the electric source (not shown) with DC 12 volts. Also, the motion sensor 24 is actuated to operate the fan means 43 while the user sits on the seat ring 36 upon opening the small toilet seat cover 37 and in turn the motion sensor 24 is deactivated when the user stands. On the other hand, the user is apart from the predetermined area from the motion sensor 24, the motion sensor 24 is inoperative. The predetermined area is about 1 foot from the motion sensor 24.

As shown in FIGS. 1 and 2, the gas exhaust duct 13 has an U-shaped configuration and disposed in the toilet holding tank 11. The gas exhaust duct 13 is higher than water level of the toilet holding tank 11 and is provided with a gas duct 27 and a gas-water duct 28 to form the U-shaped configuration as a composite structure. The gas duct 27 stands at an aperture 42' of the toilet holding tank 11 and the top end of the ventilation conduit 42 for communicating with the ventilation conduit 42. Also, the gas-water duct 28 stands at apertures 49 and 49' of the toilet stool 12 and the toilet holding tank 11, respectively (FIG. 3). The U-shaped gas exhaust duct 13 is provided with the wire containing line 34 at the top portion thereof for containing the electric wire 26 which is connected to the water-proof fan 43 and the electric source (not shown). Also, the U-shaped gas exhaust duct 13 is connected to and communicated with the ventilation conduit 42 and the flush ring 39 through a tunnel 41 so that a kind of sealing system for the toilet holding tank 11 does not require when compared with the conventional vent toilets.

The gas-water duct 28 is provided with a water overflow tube 30 having a ball seat 51 disposed at the top thereof and a net ball cap 31 extending from the ball seat 51 for moving a water overflow controlling movable ball valve 32 between the ball seat 51 and the net ball cap 31 so as to allow to discharge overflowing flush water 48 from the toilet holding tank 11 thereto by the float of the water overflow controlling movable ball valve 32 upon overflowing the flush water 48. Thus the net ball cap 31 has same height to that of the U-shaped duct 13 so that the top portion of the U-shaped duct 13 does not fill up with the water in any event. A water hose 19 is connected to the upper portion of the gas-water duct 28 for allowing fresh water 48 to be passed into the gas-water duct 28.

As shown in FIGS. 2 and 3, the gas-water duct 28 is connected to the tunnel 41 at the bottom end thereof through apertures 49 and 49, of the toilet stool 12 and the toilet holding tank 11, respectively. And the gas-water duct 28 is provided with a horizontal flapper tube 29 connected to the lower portion thereof. Also, the flapper valve 29 has an inclined inlet for easily closing and opening by the flapper valve 23. The flapper valve 23 is pivotally connected to the flapper tube 29 by a hinge 52. The chain 22 is connected to the flapper valve 23 and the flush handle 16. Therefore, upon pushing the flush handle 16, the flapper valve 23 is opened to flow the flush water 48 to the toilet bowl 33.

According to the present invention, the toilet assembly 10 operates as follows:

First of all, upon opening the toilet seat cover 37, while the user sits on the seat ring 36, the motion sensor 24 is actuated to operate the fan means 43 and simultaneously the sensor acting light 25' is actuated At this time, the objectionable odor from the toilet bowl 33 through the plurality of openings 40 and the tunnel 41 is ventilated and discharged to the ventilation conduit 48 and directly to the sewer line 47 through the annular wide end portion 46. At that time, as shown in FIG. 2, the U-shaped gas exhaust duct 13 is connected to an communicating with the ventilation conduit 42 and the tunnel 41. Therefore, the objectionable odor gas from the toilet bowl 33 exhausts to the U-shaped gas exhaust duct 13. That is, the odor is continuously passed the gas duct 28, the gas-water duct 27, the ventilation conduit 42, and finally the sewer discharge line 47. Also, the water overflow controlling ball valve 32 tightly closes the ball seat 20 of the water overflow tube 28. Thus, the U-shaped duct 13 continuously maintains a vacuum state so that the objectionable odor gas is effectively ventilated.

Second, as shown in FIG. 2 in turn when the user stands and flushes the toilet assembly 10 by pushing the flush handle 16, the motion sensor 24 is inoperative and simultaneously the flapper valve 23 is open and the movable ball valve 32 moves down to the ball seat 20 to tightly close the water overflow tube 30 due to the water pressure. Therefore, the flush water 48 flows to the toilet bowl 33 from the toilet holding tank 11 therethrough. At this time, simultaneously the flush water 48 effectively discharges the waste product and associated objectionable odor directly to the sewer discharge line 47 through the siphon conduit 45. At that time, the waste product does not plug up the ventilation conduit 42 when compared with the conventional vent toilets. Because the siphon conduit 45 extends annularly around the siphon conduit 45 at the point where they communicate with the sewer discharge line 47.

When the float valve 21 and/or the float member 17 are out of order, the flush water 48 overflows the toilet holding tank 11. At this time, the overflowing water makes the water overflow controlling valve 32 to move up. Therefore, the water overflow controlling movable valve 32 is released from the ball seat 20 to open so as to allow to discharge overflowing flush water form the toilet holding tank 11 to the toilet stool 12 therethrough.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A ventilating toilet assembly comprising:

a toilet stool having a toilet bowl, said toilet stool including a back wall portion, a flush ring disposed at the upper end of said toilet bowl, a plurality of openings communicating with said flush ring for allowing flush water to be flushed into the toilet bowl from the flush ring, a seat ring disposed on said flush ring, a toilet seat cover disposed on a peripheral inside edge of said seat ring, and a siphon conduit connected to and communicating the toilet bowl with a sewer discharge line for discharging waste product directly from the toilet bowl to said line, a ventilation conduit formed in said stool and being disposed adjacent to the back wall portion of said toilet stool for ventilating objectional odor from said toilet bowl, said ventilation conduit extending annularly around said siphon conduit at a lower portion of said stool at a point where they communicate with said sewer discharge line, said ventilation conduit housing a fan disposed in a slot in a portion of said conduit, a toilet holding tank for containing flush water, said toilet holding tank having a water intake valve and an opening leading to said bowl, a motion sensor disposed on the front exterior of said toilet holding tank facing said toilet stool, said motion sensor being free of interference from the opening and closing of the toilet seat cover, a multifunctional tube having an inverted U-shaped configuration with a first leg of the U-shaped multifunctional tube being disposed in said opening in said toilet holding tank, which the first leg serves as a first gas exhaust tube connected to said flush ring, wherein said first leg has a water overflow tube having a ball seat disposed at the top thereof and a net ball cap extending from the ball seat, the net ball cap having the same height as that of the U-shaped multifunctional tube, a horizontal flapper tube extending laterally of said first leg and having a flapper valve seated thereon, a second leg of said U-shaped configuration tube being connected to said ventilation conduit and serving as a second gas exhaust tube, and a water overflow controlling movable floating ball valve disposed to move between said ball seat and said net ball cap of said water overflow tube for allowing discharge of overflowing flush water in the toilet holding tank to the toilet bowl, upon water rising above in said ball seat, the water overflow movable ball valve is floated and separated from the ball seat so as to open the water overflow tube, whereby with the toilet seat cover open, while the user sits on the seat ring, the motion sensor is actuated to operate the fan and the objectionable odor is ventilated, and in turn when the user stands and flushes the toilet assembly, the motion sensor is deactivated and simultaneously, the flush water discharges the waste product and associated objectionable odor directedly to the sewer discharge line.

2. The ventilating toilet assembly of claim 1, wherein said fan contains a water-proof fan motor.

3. The ventilating toilet assembly of claim 1, wherein the motion sensor contains a detector and sensor acting light and is connected to the electric source with DC 12 volts.

4. The ventilating toilet assembly of claim 3, wherein the motion sensor is inoperative when the user is apart from the predetermined area therefrom.

5. The ventilating toilet assembly of claim 4, wherein the predetermined area is about 1 foot from the motion sensor.

* * * * *